US009605479B2

(12) United States Patent
Muto

(10) Patent No.: US 9,605,479 B2
(45) Date of Patent: Mar. 28, 2017

(54) SCREEN WINDOW FOR GARAGE DOOR

(71) Applicant: Carla Muto, Plainfield, IL (US)

(72) Inventor: Carla Muto, Plainfield, IL (US)

( * ) Notice: Subject to any disclaimer, the term of this patent is extended or adjusted under 35 U.S.C. 154(b) by 0 days.

(21) Appl. No.: 14/694,939

(22) Filed: Apr. 23, 2015

(65) Prior Publication Data

US 2015/0225998 A1 Aug. 13, 2015

Related U.S. Application Data

(63) Continuation-in-part of application No. 14/268,256, filed on May 2, 2014, now abandoned, which is a continuation of application No. 13/768,836, filed on Feb. 15, 2013, now abandoned.

(51) Int. Cl.

| | |
|---|---|
| ***E06B 3/00*** | (2006.01) |
| ***E06B 9/52*** | (2006.01) |
| ***E06B 7/10*** | (2006.01) |
| ***E06B 3/48*** | (2006.01) |
| ***E06B 3/54*** | (2006.01) |
| ***E06B 3/58*** | (2006.01) |
| ***E06B 7/30*** | (2006.01) |
| *E05D 15/06* | (2006.01) |

(52) U.S. Cl.

CPC ..... *E06B 9/52* (2013.01); *E06B 3/485* (2013.01); *E06B 3/549* (2013.01); *E06B 3/5892* (2013.01); *E06B 7/10* (2013.01); *E06B 7/30* (2013.01); *E05D 15/06* (2013.01); *E06B 2009/527* (2013.01)

(58) Field of Classification Search

CPC . E06B 9/52; E06B 9/485; E06B 9/549; E06B 9/5892; E06B 7/09; E06B 7/10; E06B 7/30; E06B 7/28; E06B 3/26; E06B 3/2605; E06B 3/46; E06B 3/32; E06B 3/4609; E06B 3/4618

USPC ..... 160/113, 116, 180; 52/204.6, 204.5, 52/204.51

See application file for complete search history.

(56) References Cited

U.S. PATENT DOCUMENTS

| | | | | |
|---|---|---|---|---|
| 2,841,834 | A * | 7/1958 | Poole, Jr. | E06B 3/4609 49/489.1 |
| 3,908,730 | A * | 9/1975 | Goss, Jr. | E06B 3/28 160/90 |
| 4,124,054 | A * | 11/1978 | Spretnjak | E06B 3/4681 160/90 |
| 4,141,403 | A * | 2/1979 | Church | E05D 15/24 160/201 |
| 4,314,598 | A * | 2/1982 | Roesch | E06B 3/44 160/90 |
| 4,333,283 | A * | 6/1982 | Ebata | E06B 3/2605 49/504 |

(Continued)

*Primary Examiner* — Katherine Mitchell
*Assistant Examiner* — Johnnie A Shablack
(74) *Attorney, Agent, or Firm* — The Gray Law Group, Ltd; Robert W. Gray

(57) ABSTRACT

A sliding screen window for a garage door may be built into new garage doors or may be sold separately for installation on existing garage doors. The window would generally, but not necessarily, be installed on the top panel of a garage door. The screen panel may be oblong in shape or may feature a decorative pattern of screened and non-screened shapes. Behind the screen is a plurality of transparent or opaque sliding plates that may be moved aside to allow air to flow through the garage door.

15 Claims, 4 Drawing Sheets

(56) References Cited

U.S. PATENT DOCUMENTS 4,378,043 A * 3/1983 Sorenson ..... E06B 7/03 160/201
4,411,111 A * 10/1983 Hosooka ..... E06B 1/32 49/504
4,483,099 A * 11/1984 Schmidt ..... E06B 3/4618 49/504
4,653,566 A * 3/1987 Miale ..... E06B 9/54 160/113
4,656,778 A * 4/1987 Fiorenza, Sr. ..... E06B 3/28 160/90
4,922,658 A * 5/1990 Coddens ..... E06B 3/4609 49/458
4,924,628 A * 5/1990 Ruby ..... E06B 3/4609 49/380
4,936,368 A * 6/1990 Philbeck ..... B60J 1/1853 160/105
5,189,862 A * 3/1993 Lafleur ..... E06B 3/2605 52/204.593
5,192,112 A * 3/1993 Gherardi ..... B62D 33/06 160/90
5,469,906 A * 11/1995 Cason ..... B60J 1/2011 160/105
5,497,588 A * 3/1996 Martin ..... E06B 3/72 52/208
5,611,382 A * 3/1997 Sferra ..... E06B 9/52 160/113
5,799,449 A * 9/1998 Lyons ..... B60J 1/1853 296/146.1
5,976,009 A * 11/1999 Achen ..... E06B 7/082 454/195
5,996,674 A * 12/1999 Gatewood ..... A47H 13/14 160/113
6,016,861 A * 1/2000 Davis ..... B60J 1/1853 160/105
6,026,886 A * 2/2000 Diamond-Martinez E06B 3/685 160/113
6,089,800 A * 7/2000 Tabellini ..... B23Q 11/0825 160/202
6,131,345 A * 10/2000 Pelusio ..... E06B 3/7001 428/13
6,272,801 B1 * 8/2001 Suh ..... E06B 3/5892 49/505
6,415,844 B1 * 7/2002 Smith ..... E06B 9/52 160/216
6,484,789 B1 * 11/2002 Ober ..... E06B 9/52 160/104
6,763,638 B1 * 7/2004 Berger, Jr. ..... E06B 3/5892 52/204.5
7,007,735 B1 * 3/2006 Lake ..... E06B 9/52 160/374.1
7,040,373 B2 * 5/2006 Snyder ..... E06B 3/7005 160/113
7,082,727 B2 * 8/2006 Schmidt ..... E06B 1/18 49/308
7,146,769 B1 * 12/2006 Culverson ..... E06B 1/702 52/204.5
7,155,862 B2 * 1/2007 Bourque ..... B60J 1/1853 49/209
7,207,372 B2 * 4/2007 Dorest ..... E06B 9/52 160/180
7,234,502 B2 * 6/2007 O'Malley ..... E05D 13/1261 160/191
7,299,853 B2 * 11/2007 Brown ..... E06B 3/485 160/201
7,484,286 B2 * 2/2009 Fowler ..... E06B 3/7001 160/104
7,698,863 B2 * 4/2010 Forsland ..... E06B 3/685 52/204.61
7,918,063 B2 * 4/2011 Etemadi ..... E06B 3/549 40/706
7,954,285 B2 * 6/2011 Taylor ..... E06B 3/5892 52/204.53
7,971,623 B2 * 7/2011 Barnard ..... E06B 3/485 160/116
8,201,367 B2 * 6/2012 Barnard ..... E06B 3/5892 52/204.54
8,381,444 B1 * 2/2013 McDonald ..... E05D 15/0608 49/213
8,756,897 B1 * 6/2014 Kelley ..... E06B 3/00 52/309.4
8,826,574 B2 * 9/2014 Eichner ..... G09F 7/18 40/725
2001/0042348 A1 * 11/2001 Lundahl ..... E06B 9/52 52/202
2002/0124494 A1 * 9/2002 Zen ..... E06B 3/20 52/204.1
2003/0041539 A1 * 3/2003 Bernacki ..... E06B 3/5892 52/204.54
2003/0221803 A1 * 12/2003 Forsland ..... E06B 3/485 160/229.1
2004/0056829 A1 * 3/2004 Libby ..... E06B 7/28 345/87
2005/0144861 A1 * 7/2005 Petta ..... E06B 3/4618 52/204.1
2005/0194106 A1 * 9/2005 Scales ..... E05D 15/24 160/201
2006/0059780 A1 * 3/2006 Petta ..... E06B 3/44 49/163
2006/0086052 A1 * 4/2006 Petta ..... B29C 47/0028 49/404
2007/0151156 A1 * 7/2007 Thielmann ..... E05B 65/0864 49/125
2007/0193704 A1 * 8/2007 Brown, Jr. ..... E06B 3/485 160/201
2007/0199245 A1 * 8/2007 Peters ..... E05B 65/1033 49/141
2007/0266653 A1 * 11/2007 Martinez ..... E06B 3/4609 52/204.1
2009/0223131 A1 * 9/2009 Wiese ..... E06B 3/485 49/197
2010/0115877 A1 * 5/2010 Yoo ..... E05D 15/0686 52/656.2
2010/0269414 A1 * 10/2010 Horton ..... E06B 3/7001 49/197
2011/0047904 A1 * 3/2011 Etemadi ..... E06B 3/549 52/204.7
2013/0008089 A1 * 1/2013 Mancebo ..... E06B 3/4618 49/413
2013/0326973 A1 * 12/2013 Rivera ..... E06B 3/28 52/202
2014/0000195 A1 * 1/2014 Daniels ..... B32B 13/02 52/232
2014/0196377 A1 * 7/2014 Muto ..... E06B 3/485 49/465
2014/0230335 A1 * 8/2014 Muto ..... E06B 3/485 49/465
2015/0225998 A1 * 8/2015 Muto ..... E06B 9/52 49/465

* cited by examiner

SCREEN WINDOW FOR GARAGE DOOR

CROSS-REFERENCE TO RELATED APPLICATIONS

This application is a continuation in part of copending U.S. patent application Ser. No. 14/268,256, filed on Oct. 20, 2014, which was a continuation of U.S. patent application Ser. No. 13/768,836, filed on Feb. 15, 2013 and now abandoned, which are hereby incorporated by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates in general to the field of building fixtures, and in particular to the field of windows for garage doors. Paneled garage doors are used in a wide variety of contexts in homes and commercial buildings, and generally for the entrance to spaces used for storing vehicles and other goods, and for conducting various forms of work. Frequently, it is desirable to allow air to flow into and out of these spaces, but problematic for the garage door to simply be left open. For example, a garage door owner may wish to leave a space concealed by a garage door unattended or may wish to prevent insects from entering the space as it is allowed to be aired out.

It is useful, therefore, to have a screened window available within a garage door. In such situations as above, the garage door owner may open the window and allow air to pass between the concealed space and the outside.

SUMMARY OF THE INVENTION

Accordingly, the invention is directed to a sliding screen window for a garage door. The window may be built into new garage doors or may be sold separately for installation on existing garage doors. The window would generally, but not necessarily, be installed on the top panel of a garage door. The screen panel may be oblong in shape or may feature a decorative pattern of screened and non-screened shapes. Behind the screen is a plurality of transparent or opaque sliding plates that may be moved aside to allow air to flow through the garage door.

It is an object of the invention to provide a way to allow air to pass into a space concealed by a garage door without opening the garage door.

It is an object of the invention to provide a screen for preventing insects and debris from entering the space concealed by the garage door.

It is an object of the invention to allow natural light to enter a space concealed by a garage door without opening the garage door.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
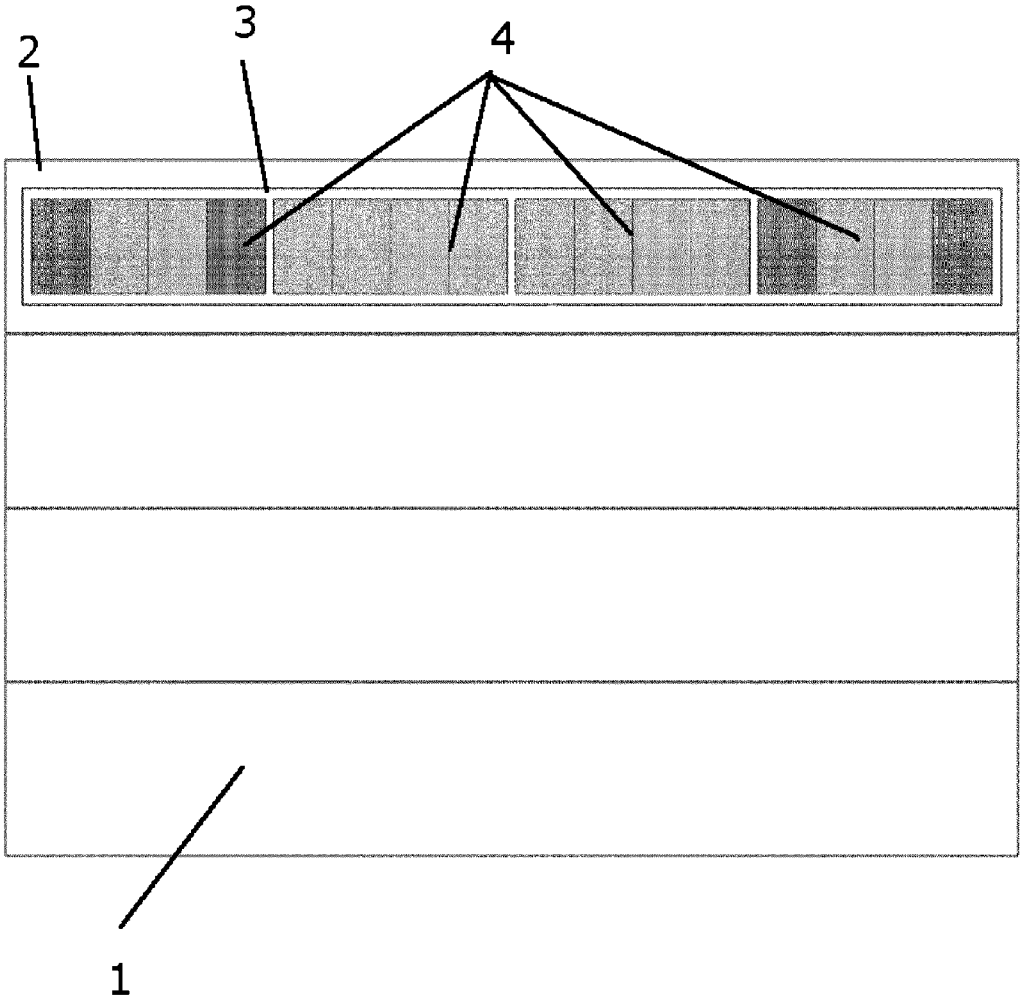
FIG. 1 shows a first basic embodiment of the invention as installed in a garage door.
Figure 2:
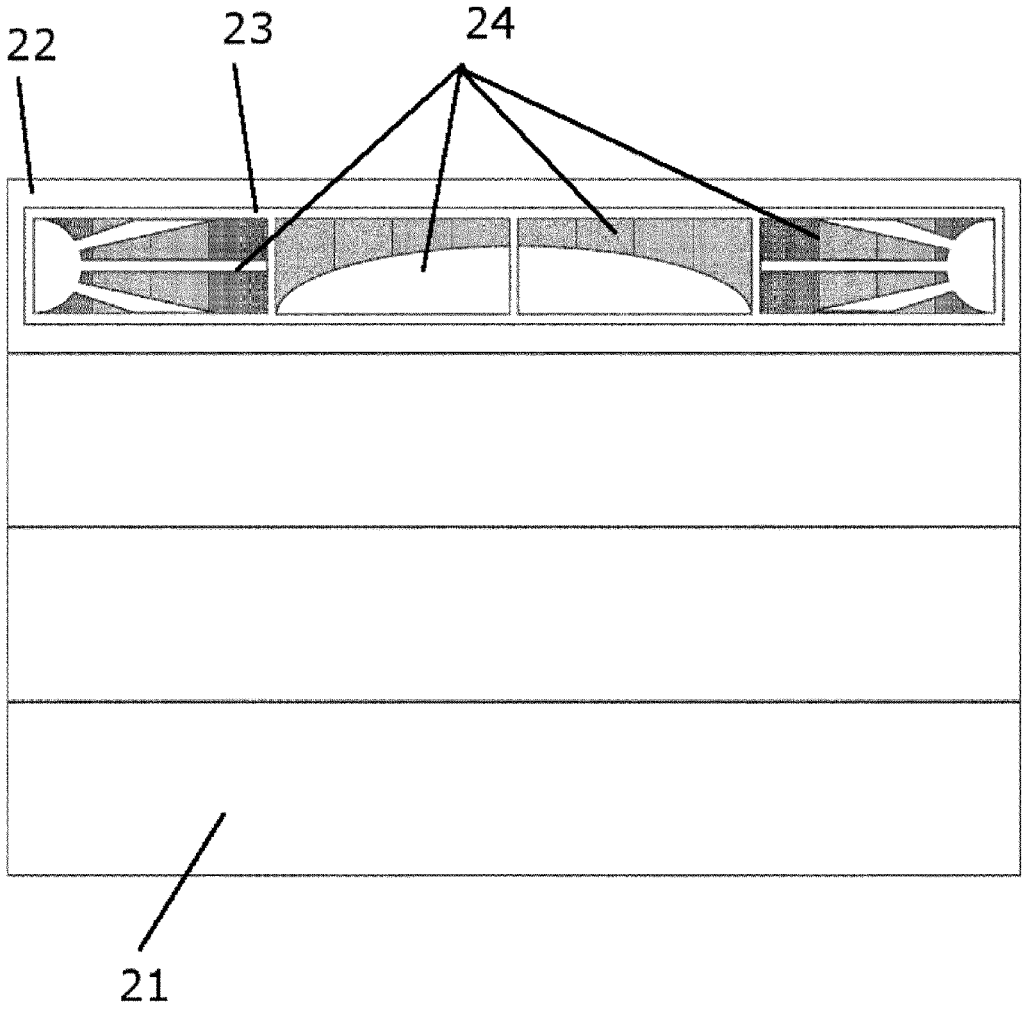
FIG. 2 shows a second decorative embodiment of the invention as installed in a garage door.
Figures 5, 6:
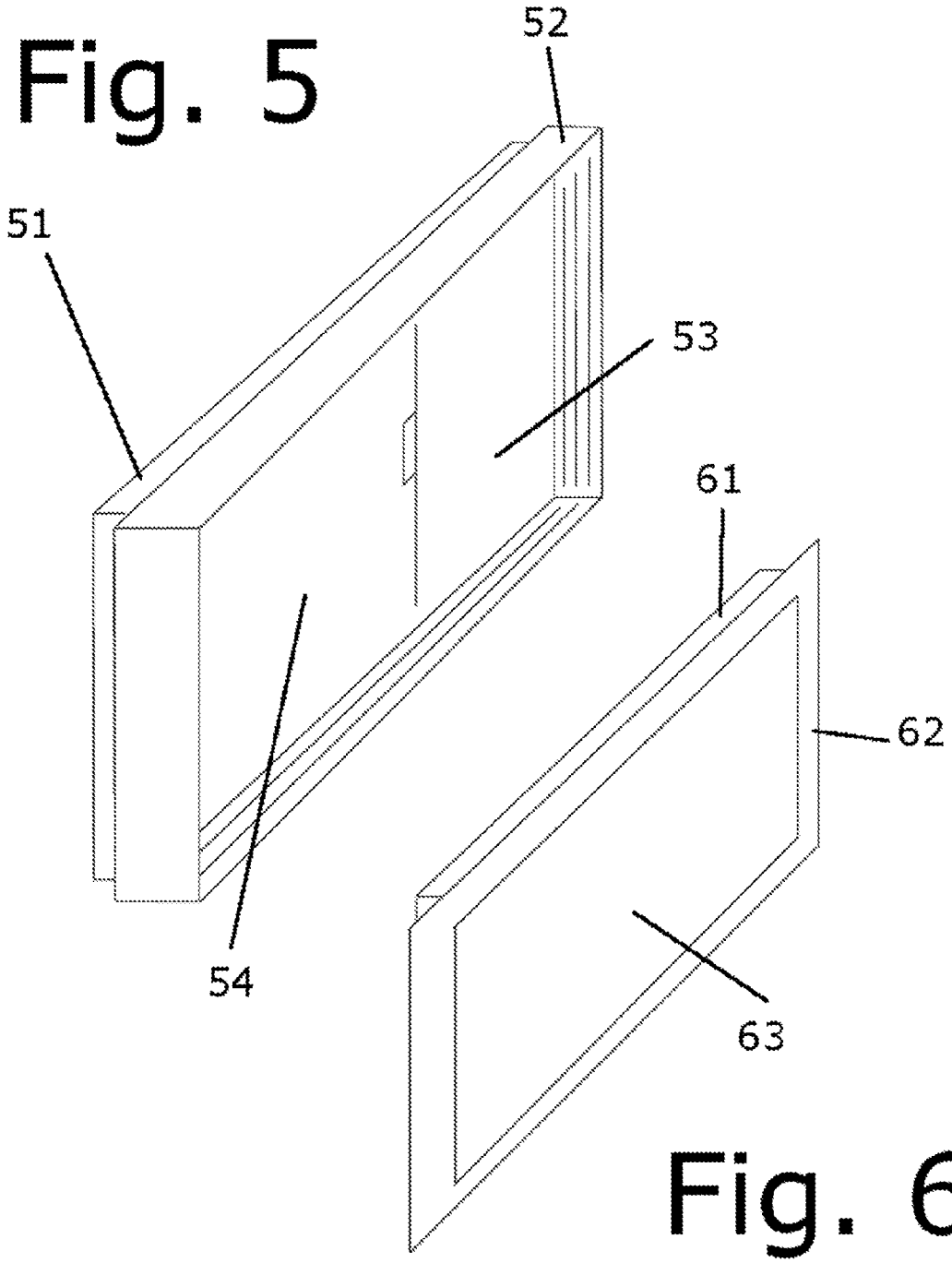
FIG. 5 shows a side-angle view of a fifth embodiment of the invention.
FIG. 6 shows a side-angle view of a sixth embodiment of the invention.

Referring now to the invention in more detail, FIGS. 1 and 2 show the basic concept of the invention as a screen window for a garage door as installed on the top panel of a garage door. FIG. 1 shows a basic first embodiment in which the garage door (1) on its top panel (2) features a window (3) with an outer screen layer (4). In the first embodiment, the screen portions are oblong in shape. FIG. 2 shows a more decorative second embodiment, again featuring a garage door (21) whose top panel (22) has been penetrated by a window (23), and the various sections of the window (23) are partly covered by screen (24) and partly by opaque material. Each window panel may be filled with one or more layers of screen material, transparent non-screen material, and opaque non-screen material. Generically, transparent non-screen materials and opaque non-screen materials in the context of the present invention may be understood as a "sheet" of material. These layers may or may not be able to slide horizontally or otherwise be opened to allow air to pass, though preferably at least one layer, for example a screen or glass layer, wholly covers the window opening as shown in FIGS. 1 and 6. Many suitable garage door materials and designs are known in the prior art; likewise may screen and non-screen window materials are known in the prior art and readily available (e.g. metal screens, glass windows). The window frame components may be made of wood, aluminum, vinyl, or other commonly available building materials.

Figure 3:
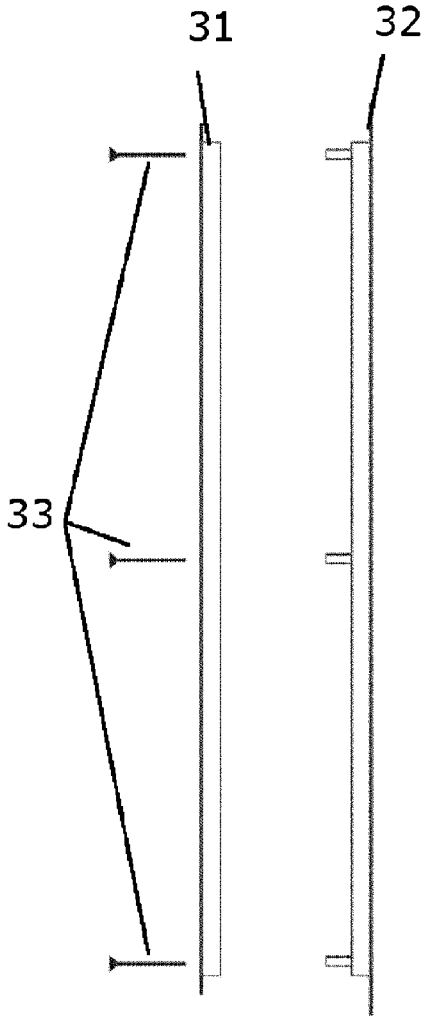
FIG. 3 shows an expanded top view of a third embodiment of the invention.

Turning now to the construction of the windows, FIG. 3 shows a third exemplary embodiment of the invention in expanded top view. In the third embodiment, an interior window frame (31) penetrates a hole in the garage door from the inside, while an exterior window frame (32) penetrates the garage door from the outside. As shown in FIG. 3, the interior window frame 31 and the exterior window frame 32 are necessarily separate and distinct monolithic pieces. The two couple together through the hole in the garage door and are fastened together by a fastener (33), which is shown as a screw, however alternative fasteners such as nails, adhesives, and the like may be used.

Figure 4:
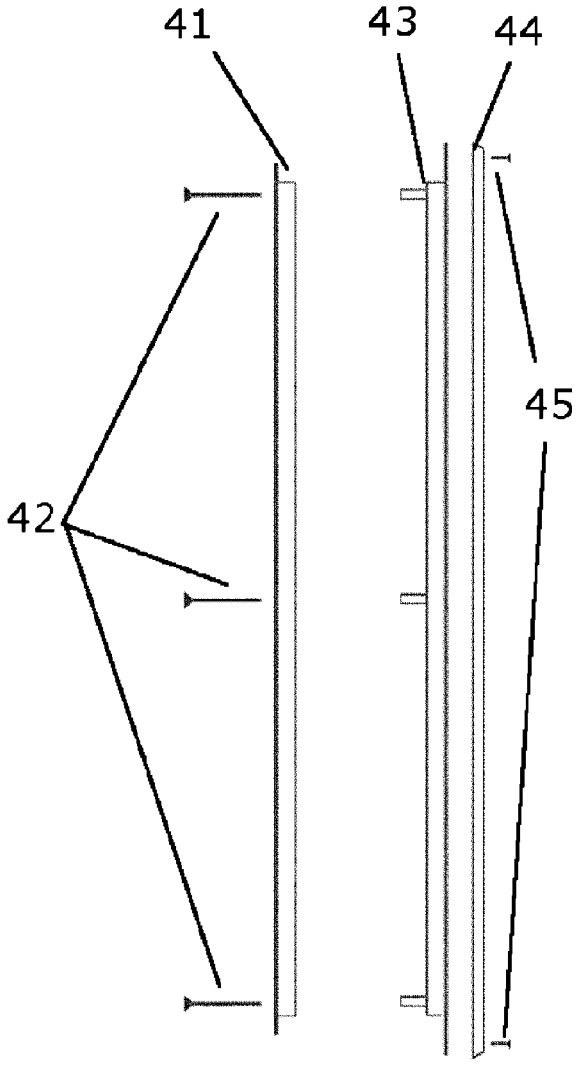
FIG. 4 shows an expanded top view of a fourth embodiment of the invention.

FIG. 4 shows a fourth exemplary embodiment in expanded top view. The fourth embodiment, like the third embodiment, features an interior window frame (41) and an exterior window frame (43), which couple through a hole in the garage door and are fastened by a set of fasteners (42), which may be screws or other types. In the fourth embodiment, an additional layer (44) is added to the exterior of the window. The additional layer (44) is fastened to the exterior window frame (43) by a set of fasteners (45), which may, but need not, be screws. Contrasting the third and fourth embodiments, in the third embodiment, all layers of window material (i.e. a screen, optional transparent material, and optional opaque material) must fit within a shallow depth determined by the window frame. However, in the fourth embodiment, one or more of such materials may be installed in the additional layer (44). As shown and described herein, the additional layer (44) may be understood as a third frame which would contain a second distinct plurality of window materials mounted therein as opposed to the first or previously described plurality, which are mounted within the interior frame (41), exterior frame (42), or the two in combination.

Turning now to the sliding configuration of the window, FIG. 5 shows a side angle view of a fifth exemplary embodiment of the invention. In the fifth embodiment, an interior frame (51) is coupled to an external frame (52) to create a housing with a plurality of sliding tracks for panels of material that fill the vertical space of the window frame and approximately half the horizontal space of the window frame. A first panel (53) and a second panel (54) are allowed to slide past each other when the user applies a manual force to one side or the other. As above, the terms "panel" and "sheet" in the context of the present invention are used interchangeably. Together, the first panel (53) and the second panel (54) may be understood as a "pair of sheets". The sliding panels may be screen panels, transparent panels, or opaque panels, and may be placed in front of or behind additional panels.

To compare, FIG. 6 shows a sixth embodiment of the invention featuring An interior frame (61) coupled through a hole in the garage door to an exterior frame (62) featuring an additional layer (63). The additional layer may be a screen panel concealing slidable or openable opaque panels.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A screen window comprising:

(a) a rigid panel substrate forming the top panel of a garage door;

(b) said rigid panel substrate having a rough opening;

(c) a first frame having a rigid perimeter and being substantially open in its center;

(d) said first frame being of a size and shape to conform to and fit snugly within said rough opening;

(e) a second frame having a rigid perimeter, being substantially open in its center, and being a monolithic member separate from said first frame;

(f) said second frame being of a size and shape to conform to and fit snugly within the perimeter of said first frame;

(g) a first fastening means for fastening said first frame to said second frame such that said first and second frames are fixed to one another through said rough opening;

(h) said first frame and said second frame being affixed to one another by said first fastening means;

(i) a plurality of layers, each taken from any one of the group consisting of non-sliding screens, slidable screens, non-sliding sheets of rigid transparent materials, non-sliding sheets of rigid opaque material, slidable sheets of rigid transparent material, and slidable sheets of rigid opaque material;

(j) said plurality of layers being fixedly or slidably retained directly within said second frame and not retained using any additional structure;

(k) each layer of said plurality of layers wholly or partially covering the inside area of said second frame, and at least one of said plurality of layers wholly covering the inside area of said second frame;

(l) said plurality of layers comprising a screen fixedly retained within said second frame such that said screen fully covers the inside area of said second frame;

(m) said plurality of layers further comprising a pair of sheets of transparent material slidably retained within said second frame, each of which covers about half of the inside area of said second frame; and (n) said plurality of layers further comprising an opaque layer fixedly mounted within said second frame and decoratively cut to cover less than the full inside area of said second frame;

whereby light and ventilation are provided to an enclosed space located on the inside of said rigid panel substrate.

2. The screen window of claim 1 wherein said plurality of layers further comprises a sheet of transparent material fixedly mounted and retained within said second frame such that said sheet of transparent material fully covers the inside area of said second frame.

3. The screen window of claim 1 wherein a third frame having a rigid perimeter and being substantially open in its center is provided, said third frame being of a size and shape to substantially cover the exterior surface of said first frame or said second frame, and said third frame being fixedly attached to the exterior surface of said first frame or said second frame with a second fastening means for fastening said third frame to the exterior surface of said first frame or said second frame such that said third frame is readily interchangeable with alternative third frames.

4. The screen window of claim 3 wherein a second plurality of layers taken from the group of non-sliding screens, slidable screens, non-sliding sheets of rigid transparent materials, non-sliding sheets of rigid opaque material, slidable sheets of rigid transparent material, and slidable sheets of rigid opaque material is provided, said second plurality of layers being fixedly or slidably retained within said third frame, and each layer of said second plurality of layers wholly or partially covering the inside area of said third frame.

5. The screen window of claim 4 wherein a greater set of layers is defined as including all of said plurality of layers and said second plurality of layers, and wherein said greater set of layers comprises a screen fixedly retained within said second frame or said third frame such that said sheet of transparent material fully covers the inside area of said second frame or said third frame.

6. The screen window of claim 5 wherein said greater set of layers further comprises a pair of sheets of transparent material slidably retained within said second frame or said third frame, each of which covers about half of the inside area of said second frame or said third frame.

7. The screen window of claim 6 wherein said greater set of layers further comprises an opaque layer fixedly mounted within said second frame or said third frame and decoratively cut to cover less than the full inside area of said second frame or said third frame.

8. A screen window comprising:

(a) a rigid panel substrate forming the top panel of a garage door;

(b) said rigid panel substrate having a rough opening;

(c) a first frame having a rigid perimeter and being substantially open in its center;

(d) said first frame being of a size and shape to conform to and fit snugly within said rough opening;

(e) a second frame having a rigid perimeter, being substantially open in its center, and being a monolithic member separate from said first frame;

(f) said second frame being of a size and shape to conform to and fit snugly within the perimeter of said first frame;

(g) a first fastening means for fastening said first frame to said second frame such that said first and second frames are fixed to one another through said rough opening;

(h) said first frame and said second frame being affixed to one another by said first fastening means;

(i) a plurality of layers, each taken from any one of the group consisting of non-sliding screens, slidable screens, non-sliding sheets of rigid transparent materials, non-sliding sheets of rigid opaque material, slidable sheets of rigid transparent material, and slidable sheets of rigid opaque material;

(j) said plurality of layers being fixedly or slidably retained directly within said second frame and not retained using any additional structure;

(k) each layer of said plurality of layers wholly or partially covering the inside area of said second frame, and at least one of said plurality of layers wholly covering the inside area of said second frame;

(l) wherein a third frame having a rigid perimeter and being substantially open in its center is provided, said third frame being of a size and shape substantially cover the exterior surface of said first frame or said second frame, and said third frame being fixedly attached to the exterior surface of said first frame or said second frame with a second fastening means for fastening said third frame to the exterior surface of said first frame or said second frame such that said third frame is readily interchangeable with alternative third frames; and (m) wherein a second plurality of layers taken from the group of non-sliding screens, slidable screens, non-sliding sheets of rigid transparent materials, non-sliding sheets of rigid opaque material, slidable sheets of rigid transparent material, and slidable sheets of rigid opaque material is provided, said second plurality of layers being fixedly or slidably retained within said third frame, and each layer of said second plurality of layers wholly or partially covering the inside area of said third frame;

whereby light and ventilation are provided to an enclosed space located on the inside of said rigid panel substrate.

9. The screen window of claim 8 wherein said plurality of layers comprises a sheet of transparent material fixedly mounted retained within said second frame such that said sheet of transparent material fully covers the inside area of said second frame.

10. The screen window of claim 8 wherein said plurality of layers comprises a screen fixedly retained within said second frame such that said sheet of transparent material fully covers the inside area of said second frame.

11. The screen window of claim 10 wherein said plurality of layers further comprises a pair of sheets of transparent material slidably retained within said second frame, each of which covers about half of the inside area of said second frame.

12. The screen window of claim 11 wherein said plurality of layers further comprises an opaque layer fixedly mounted within said second frame and decoratively cut to cover less than the full inside area of said second frame.

13. The screen window of claim 8 wherein a greater set of layers is defined as including all of said plurality of layers and said second plurality of layers, and wherein said greater set of layers comprises a screen fixedly retained within said second frame or said third frame such that said sheet of transparent material fully covers the inside area of said second frame or said third frame.

14. The screen window of claim 13 wherein said greater set of layers further comprises a pair of sheets of transparent material slidably retained within said second frame or said third frame, each of which covers about half of the inside area of said second frame or said third frame.

15. The screen window of claim 14 wherein said greater set of layers further comprises an opaque layer fixedly mounted within said second frame or said third frame and decoratively cut to cover less than the full inside area of said second frame or said third frame.

* * * * *